US005575192A

United States Patent [19]

Eggert

[11] Patent Number: 5,575,192

[45] Date of Patent: Nov. 19, 1996

[54] RETENTION OF SHANK IN HANDLE OF RATCHETING DRIVER

[75] Inventor: Daniel M. Eggert, Kenosha, Wis.

[73] Assignee: Snap-on Technologies, Inc., Crystal Lake, Ill.

[21] Appl. No.: 522,514

[22] Filed: Sep. 1, 1995

[51] Int. Cl.[6] ..... B25B 13/46

[52] U.S. Cl. ..... 81/63.1; 81/436; 192/43.2

[58] Field of Search ..... 81/60, 63.1, 436, 81/177.1; 192/43.2

[56] References Cited

U.S. PATENT DOCUMENTS 4,060,115 11/1977 Bocanegra Marquina ..... 81/436
4,235,269 11/1980 Kraus .
4,417,611 11/1983 Kim .
4,427,100 1/1984 Rude et al. .
4,485,699 12/1984 Fuller .
4,552,043 11/1985 Corona et al. .
4,621,718 11/1986 DeCarolis .
4,735,120 4/1988 Beugelsdyk .
4,777,852 10/1988 Herman et al. .
4,779,494 10/1988 Quach .
4,793,222 12/1988 Beugelsdyk .
4,916,988 4/1990 Robertson et al. .
5,329,834 7/1994 Wong .

*Primary Examiner*—James G. Smith
*Attorney, Agent, or Firm*—Emrich & Dithmar

[57] ABSTRACT

The ratcheting driver comprises an elongated handle having a main body portion and a cap portion rotatable relative to each other about a common longitudinal axis. Rachet mechanism is disposed in a cavity in the handle and engages the mounting end of an elongated shank receivable through a cylindrical axial bore in the cap. Diametrically opposed projections project radially outwardly from the shank so as to prevent free passage through the bore, the projections being harder than the cap to permanently deform the cap and permit passage of the shank through the bore for engagement with the ratchet mechanism, the projections being freely received in the cavity to retain the shank in the handle while permitting rotation of the shank relative to the cap. Either of two types of washers may be disposed between the projections and the cap to prevent the projections from rubbing against the deformations of the cap during rotation.

15 Claims, 1 Drawing Sheet

30
31a
32
37
10
20
17
31
38
40
3
27
23
18
41
42
45
39
22
12
35
3
34
21
13
11
15
33
16
36
14

45
47
40
46
41
45

45
47
46
41
40
46
45
47

30
20
11
5
50
45
41
53
51
40
52
5
39

33
45
47
41
53
46
51
45
50
52

30
20
41
11
7
55
56
45
40
7

55
56
45
46
47
41

RETENTION OF SHANK IN HANDLE OF RATCHETING DRIVER

BACKGROUND OF THE INVENTION

1. Field of the Invention

The invention relates to a ratcheting driver used for driving screws, nuts and the like. In particular, the invention relates to a technique for mounting the driver shank to the driver ratchet mechanism.

2. Description of the Prior Art

The present invention is an improvement of the ratcheting driver disclosed in U.S. Pat. No. 4,477,852, issued Oct. 18, 1988, the disclosure of which is incorporated herein by reference. That driver has a ratchet mechanism received in an axial bore in one end of a handle, and a rotating cap which covers that end of the handle and includes an actuator for controlling a reversing apparatus on the ratchet mechanism. The cap is rotatably mounted on the ratchet mechanism and has an axial bore therethrough which receives the driver shank for engagement with the ratchet mechanism. The shank is retained in place by a lock ring, which permits free rotation of the shank relative to the cap, while preventing the shank from being removed from the handle.

This prior arrangement results in a somewhat complicated and expensive assembly procedure. More particularly, the cap must be preassembled with the shank and the lock ring before the cap is mounted in place. Thus, the shank must be inserted through the bore of the cap and the lock ring then accurately positioned on the inner end of the shank at the correct longitudinal location so that, when the cap is assembled on the handle, the shank will fully engage the ratchet mechanism and the lock ring will not interfere with either the cap or the ratchet mechanism.

SUMMARY OF THE INVENTION

It is a general object of the present invention to provide a ratcheting driver which avoids the disadvantages of prior drivers while affording additional structural and operating advantages.

An important feature of the invention is the provision of a ratcheting driver which is of relatively simple and economical construction and assembly.

In connection with the foregoing feature, another feature of the invention is the provision of a ratcheting driver of the type set forth, wherein the shank can be mounted on the handle as the last stage of the assembly operation.

A further feature is the provision of a ratcheting driver of the type set forth, wherein the shank is mounted on the handle without the use of a lock ring.

Certain ones of these and other features of the invention are attained by providing a ratcheting driver comprising: an elongated handle having a main body portion and a cap portion rotatable relative to each other about a common longitudinal axis, a cavity formed in the handle, ratchet mechanism disposed in the cavity, the cap having a cylindrical axial bore therethrough communicating with the cavity, and an elongated shank having a mounting end receivable through the bore for engagement with the ratchet mechanism in a mounted condition, the mounting end of the shank having a small projection formed thereon and projecting radially outwardly therefrom to prevent free passage of the mounting end of the shank through the bore, the cap being softer than the projection so as to be deformable thereby to permit passage of the projection and the mounting end of the shank through the bore to the mounted condition, the projection in the mounted condition being freely accommodated in the cavity to permit rotation of the shank relative to the cap and cooperating with the cap to retain the shank in its mounted condition.

Further features of the invention are attained by providing a ratcheting driver of the type described above, and further including a washer disposed in the cavity between the ratchet mechanism and the cap and having an axial opening therethrough with a radius slightly greater than that of the shank but less than the radial distance from the axis of the shank to the outermost end of the projection, the cap being permanently deformable by the projection to permit passage of the projection and the mounting end of the shank through the bore to the mounted condition, the washer being formed of a flexible resilient material and being resiliently deformable by the projection to permit passage of the projection and of the mounting end of the shaft through the opening to the mounted condition, the washer serving to space the projection from the cap.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 1:
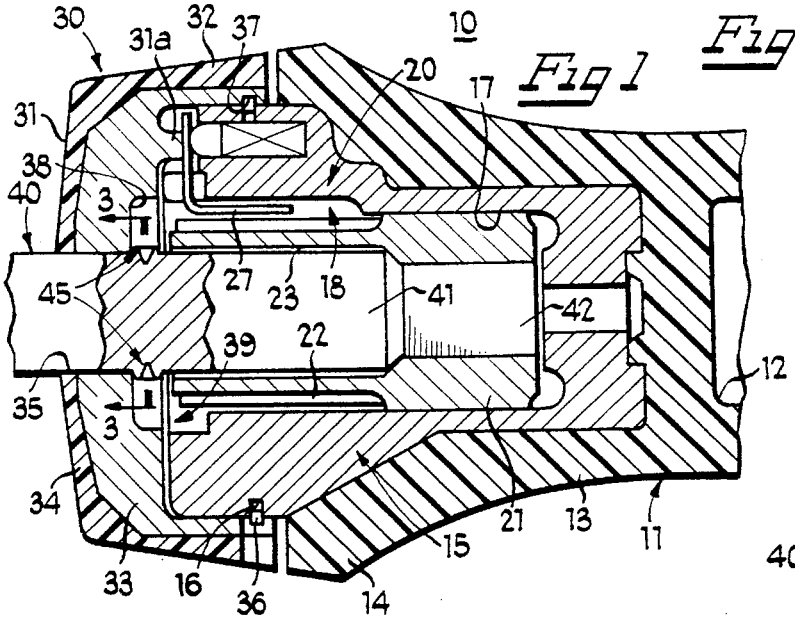
FIG. 1 is a fragmentary sectional view of a ratchet driver constructed in accordance with and embodying the features of a first embodiment of the present invention.
Figure 2:
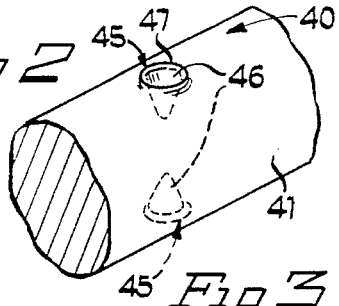
FIG. 2 an enlarged, fragmentary, perspective view of the mounting portion of the shank of the driver of FIG. 1.
Figure 3:
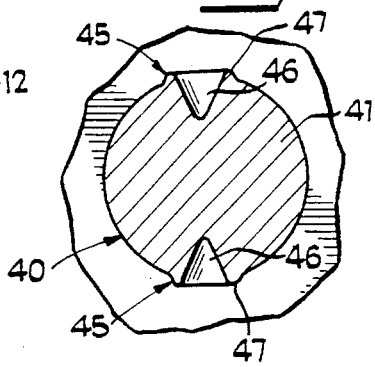
FIG. 3 is a further enlarged, fragmentary view in vertical section taken along the line 3—3 in FIG. 1.

Referring to FIGS. 1–3, there is illustrated a ratcheting driver, generally designated by the numeral 10, constructed in accordance with and embodying the features of the present invention. With the exception of the driver shank and the method of mounting same, the ratcheting driver 10 is substantially identical to that disclosed in the aforementioned U.S. Pat. No. 4,777,852 and, therefore, only so much of the construction thereof will be described herein as is necessary for an understanding of the present invention. In that prior patent, the driver is disclosed as being of the type for receiving replaceable screwdriver bits. However, it will be appreciated that the present invention is usable with any type of ratcheting driver for driving screws, nuts and the like.

The driver 10 has an elongated handle with a main body 11 provided at its rear end with a compartment 12 for storing bits. The forward end of the handle body 11 tapers into a neck 13 and then flares to form a head 14 which carries directional indicia (not shown). A metal insert 15 is mounted in the front of the handle body 11, particularly in the region of the head 14 and the neck 13. The handle body 11 is preferably constructed of a high impact plastic and the insert 15 is molded in place therein. The insert 15 has an enlarged forward end about which a groove 16 is provided, used for locking purposes, as will be described. The insert 15 has an axial cavity 17 formed therein, which is generally cylindrical in shape and is coaxial with the handle body 11. The insert 15 also has a keyway 18 which communicates with the cavity 17 and is generally tangent thereto. Mounted in the insert 15 is a ratchet mechanism 20 which includes a tubular gear 21 located in the cavity 17 and freely rotatable therein. The forward end of the gear 21 has a plurality of radially outwardly extending teeth 22. The gear 21 has an axial bore 23 formed therethrough, the rear end of which is square in transverse cross section. The teeth 22 are adapted for engagement with pawls (not shown) disposed in the keyway 18, the pawls being selectively engageable with the gear 21 under the control of an actuator 27.

The driver handle further includes a control cap 30 having a forwardly disposed end wall 31 and a circumferentially extending skirt 32. The cap 30 is defined by an inner core 33 molded in place in a plastic skin 34. The end wall 31 has a circularly axial bore or opening 35 therethrough. A retaining ring 36 simultaneously resides in the groove 16 of the insert 15 and a mating groove 37 in the skirt 32 so as to attach the cap 30 to the handle body 11 and, more particularly, to the metal insert 15, while permitting rotation of the cap 30 relative to the handle body 11 and the insert 15. The outer surface of the skirt 32 carries a pointer (not shown) which cooperates with the indicia on the handle head 14 to indicate the direction of operation of the ratchet mechanism 20. Formed in the inner surface of the core 33 coaxially surrounding the axial bore 35 is an annular recess 38 which cooperates with an annular counterbore of the cavity 17 to define a cavity 39.

The driver 10 includes an elongated, circularly cylindrical shank 40 which has a rear or mounting end 41 provided at its rearmost portion with a square tip 42. The mounting end 41 of the shank 40 has a diameter slightly less than that of the axial opening 35 through the cap 30 and is dimensioned to be received in the axial bore 23 of the gear 21, with the tip 42 fitted in the square end of the bore 23 to non-rotatably couple the shank 40 to the gear 21.

In the driver of the aforementioned U.S. Pat. No. 4,777,852, the shank is retained in place on the handle by a lock ring. It is a fundamental aspect of the present invention that the lock ring is omitted and, instead, the mounting end of the shank 40 is provided with two radially outwardly extending projections 45, respectively disposed at diametrically opposed locations on the shank 40. More particularly, as can best be seen in FIGS. 2 and 3, conical dimples 46 are formed in the outer surface of the shank 40, the material displaced forming upset radially outwardly projecting annular rims 47, which define the projections 45.

Preferably, the shank 40 and, therefore, the projections 45, are formed of a material which is substantially harder than the materials of the cap 30. Thus, in assembly of the driver 10, after the cap 30 has been mounted on the handle body 11, the mounting end 41 of the shank 40 is inserted through the axial opening 35 in the cap 30. In this regard, the radial extent of the projections 45 is such that the radial distance from the axis of the shank 40 to the plane of the outermost edge of the projection rim 47 is greater than the radius of the axial opening 35 in the cap 30. Thus, since the cap 30 is rigid, the projections 45 cannot pass freely therethrough. However, since the materials of the cap 30 are softer than that of the shank 40, the projections 45 can be forced through the axial opening 35, permanently deforming the cap 30 in the process. Thus, the shank 40 is forced through the axial opening 35 to a mounted condition illustrated in FIG. 1, wherein the mounting end 41 fully engages in the gear 21 and the projections 45 are disposed in the cavity 39 between the cap 30 and the metal insert 15. When thus disposed in its mounted condition, the shank 40 is freely rotatable relative to the cap 30 and yet, since the deformations of the cap 30 are only at two diametrically opposed locations, they do not readily permit removal of the shank 40 and, therefore, cooperate with the cap 30 to effectively retain the shank 40 in its mounted condition.

Figure 4:
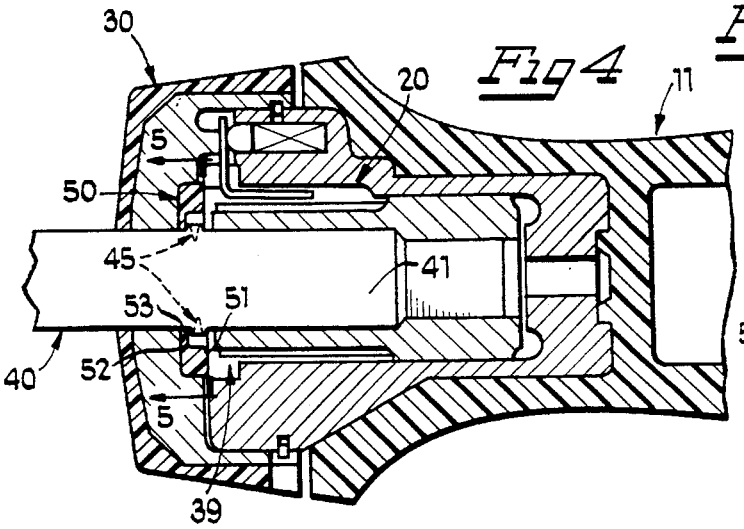
FIG. 4*f* is a view similar to FIG. 1 of another embodiment of the present invention.
Figure 5:
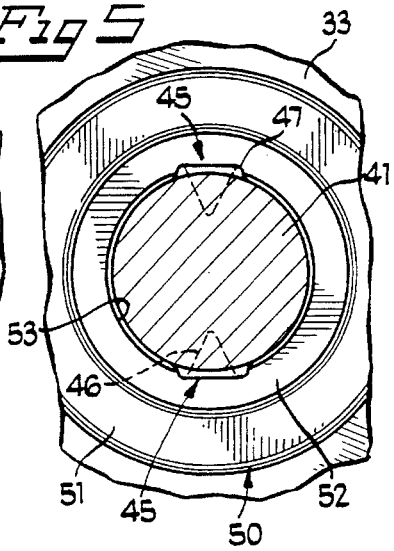
FIG. 5 is an enlarged, fragmentary view in vertical section taken along the line 5—5 in FIG. 4.

It is possible that the deformation of the cap 30 caused during mounting of the shank 40 may result in burrs of displaced cap material projecting slightly into the cavity 39. Such burrs could engage the projections 45 during relative rotation of the cap 30 and the shank 40, creating a rough "feel." In order to minimize this possibility, a washer 50 may be provided, as illustrated in FIGS. 4 and 5. More particularly, the washer 50 is formed of a flexible, resilient material, such as urethane or the like, and is dimensioned to seat in the inner recess 38 of the cap 30. The washer 50 has a thick, annular bead 51, substantially rectangular in transverse cross section, and integral at its outer edge with a thin, radially inwardly extending circular end wall 52 having a circular axial opening 53 formed therethrough, which has substantially the same diameter as the axial opening 35 of the cap 30.

In assembly, the washer 50 is seated in the recess 38 before the cap 30 is mounted on the handle body 11, with the thick bead or rim 51 projecting rearwardly. Then, when the mounting end 41 of the shank 40 is passed through the axial openings 35 and 53 during mounting of the shank 40, the projections 45 resiliently deform the washer 50 to permit the projections 45 to pass through the axial opening 53 to the mounted condition of the shank 40. In this mounted condition, the projections 45 will be accommodated in the cavity 39 rearwardly of the washer end wall 52 to permit free relative rotational movement of the cap 30 and the shank 40. Because of the resilient nature of the washer 50, its end wall 52 will resume its original, at-rest condition after the projections 45 have passed therethrough. Thus, the washer 50 will cover any burrs which may project from the cap 30 as a result of deformation thereof and prevent contact thereof with the projections 45.

Figure 6:
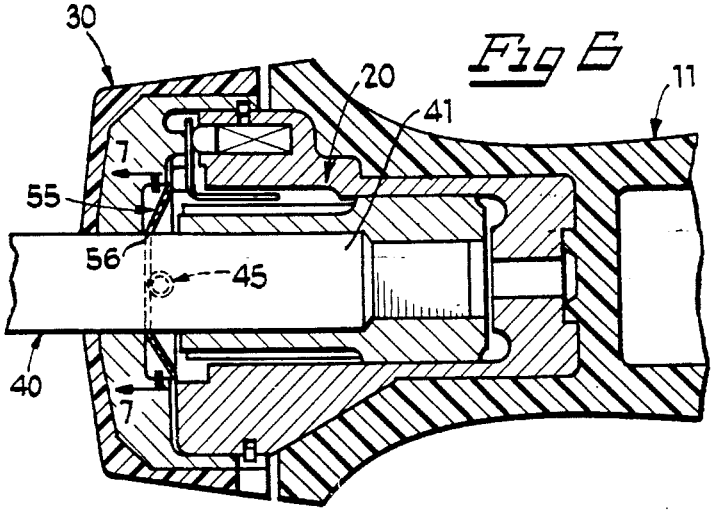
FIG. 6 is a view similar to FIG. 1 of yet another embodiment of the present invention.
Figure 7:
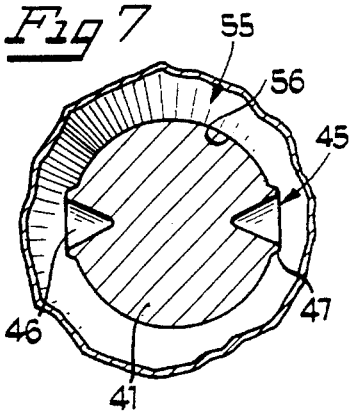
FIG. 7 is an enlarged, fragmentary view in vertical section taken along the line 7—7 in FIG. 6.

Referring to FIGS. 6 and 7, there is illustrated an alternative form of washer, generally designated by the numeral 55, which is substantially frustoconical in shape, having an axial opening 56 therethrough which is the same size and shape as the axial opening 35 of the cap 30. In assembly, the washer 55 is seated in the cap recess 38, with its wide end facing rearwardly, in the same manner as was described above with respect to the washer 50. Again, the washer 55 is formed of a flexible, resilient material, and is resiliently deformed by the projections 45 during movement of the shank 40 to its mounted condition. Otherwise, the washer 55 functions in the same manner as was described above in connection with the washer 50 to accommodate free relative rotation of the cap 30 and the shank 40, while preventing engagement of the projections 45 with any burrs which may project from the cap 30.

In a constructional model of the present invention, the shank 40 is formed of a suitably hard metal, such as a suitable steel, while the cap skin 34 may be formed of a suitable plastic and the core 33 may be formed of a suitably soft metal or alloy. Alternatively, other materials may be used for the skin 34 and the core 33 or, alternatively, the cap 30 may be unitarily constructed of a single material.

From the foregoing, it can be seen that there has been provided an improved ratcheting driver which affords a simple and inexpensive means of mounting the shank on the handle of the driver and which effectively prevents removal of the shank while accommodating free relative rotation of the shank and the rotating cap on the handle.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. A ratcheting driver comprising: an elongated handle having a main body portion and a cap portion rotatable relative to each other about a common longitudinal axis, a cavity formed in said handle, a ratchet mechanism disposed in said cavity, said cap having a cylindrical axial bore therethrough communicating with said cavity, and an elongated shank having a mounting end receivable through said bore for engagement with said ratchet mechanism in a mounted condition, said mounting end of said shank having a small projection formed thereon and projecting radially outwardly therefrom to prevent free passage of said mounting end of said shank through said bore, said cap being softer than said projection so as to be deformable thereby to permit passage of said projection and said mounting end of said shank through said bore to said mounted condition, said projection in said mounted condition being freely accommodated in said cavity to permit rotation of said shank relative to said cap and cooperating with said cap to retain said shank in its mounted condition.

2. The driver of claim 1, wherein said projection comprises an upset rim around a dimple formed in said shank.

3. The driver of claim 1, wherein said shank includes two projections projecting radially outwardly therefrom.

4. The driver of claim 3, wherein said two projections are respectively disposed at diametrically opposed locations on said shank.

5. The driver of claim 4, wherein each of said projections comprises an upset rim of a dimple formed radially in said shank.

6. The driver of claim 1, wherein said cap is formed of a rigid material and is permanently deformed by said projections.

7. The driver of claim 6, wherein said cap includes an outer plastic shell and an inner metal core.

8. A ratcheting driver comprising: an elongated handle having a main body portion and a cap portion rotatable relative to each other about a common longitudinal axis, a cavity formed in said handle, ratchet mechanism disposed in said cavity, said cap having a cylindrical axial bore therethrough communicating with said cavity, an elongated shank having a mounting end receivable through said bore for engagement with said ratchet mechanism in a mounted condition, said mounting end of said shank having a small projection formed thereon and projecting radially outwardly therefrom to prevent free passage of said mounting end of said shank through said bore, and a washer disposed in said cavity between said ratchet mechanism and said cap and having an axial opening therethrough with a radius slightly greater than said shank but less than the radial distance from the axis of the shank to the outermost end of said projection, said cap being softer than said projection so as to be permanently deformable thereby to permit passage of said projection and said mounting end of said shank through said bore to said mounted condition, said washer being formed of a flexible resilient material and being resiliently deformable by said projection to permit passage of said projection and said mounting end of said shank through said opening to said mounted condition, said projection in said mounted condition being freely accommodated in said cavity to permit rotation of said shank relative to said cap and cooperating with said cap to retain said shank in its mounted condition, said washer serving to space said projection from said cap.

9. The driver of claim 8, wherein said washer is formed of a urethane material.

10. The driver of claim 8, wherein said washer is generally cup-shaped.

11. The driver of claim 10, wherein said washer includes a thin circular end wall having said axial opening formed therethrough and integral at its outer periphery with a rearwardly extending thick annular rim.

12. The driver of claim 8, wherein said washer is substantially frustoconical in shape.

13. The driver of claim 8, wherein said projection comprises an upset rim around a dimple formed in said shank.

14. The driver of claim 8, wherein said shank includes two projections projecting radially outwardly therefrom.

15. The driver of claim 14, wherein said two projections are respectively disposed at diametrically opposed locations on said shank.

* * * * *